US011173735B2

(12) United States Patent
Endo

(10) Patent No.: US 11,173,735 B2
(45) Date of Patent: Nov. 16, 2021

(54) IMAGE FORMING APPARATUS INCLUDING A PLURALITY OF GAP ADJUSTERS

(71) Applicant: RISO KAGAKU CORPORATION, Tokyo (JP)

(72) Inventor: Hiroki Endo, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/823,396

(22) Filed: Mar. 19, 2020

(65) Prior Publication Data

US 2020/0307286 A1 Oct. 1, 2020

(30) Foreign Application Priority Data

Mar. 26, 2019 (JP) ..... JP2019-058708

(51) Int. Cl.

| | |
|---|---|
| ***B41J 25/308*** | (2006.01) |
| ***B41J 11/00*** | (2006.01) |
| ***B41J 2/02*** | (2006.01) |
| ***B41J 11/20*** | (2006.01) |

(52) U.S. Cl.

CPC ..... *B41J 25/3086* (2013.01); *B41J 2/02* (2013.01); *B41J 11/007* (2013.01); *B41J 11/0085* (2013.01); *B41J 11/20* (2013.01); *B41J 25/308* (2013.01); *B41J 25/3088* (2013.01)

(58) Field of Classification Search

CPC .. B41J 25/3086; B41J 25/3088; B41J 25/308; B41J 11/007; B41J 2/02; B41J 11/20; B41J 11/0085; B41J 2002/16591; B41J 2/01; B41J 25/001

See application file for complete search history.

(56) References Cited

U.S. PATENT DOCUMENTS

| | | | | |
|---|---|---|---|---|
| 8,356,881 | B2 | 1/2013 | Ohnishi | |
| 10,137,707 | B2 | 11/2018 | Morita | |
| 2005/0093921 | A1* | 5/2005 | Kumagai | B41J 11/20 347/37 |

(Continued)

FOREIGN PATENT DOCUMENTS

| | | |
|---|---|---|
| CN | 102066116 A | 5/2011 |
| CN | 107776213 A | 3/2018 |

(Continued)

OTHER PUBLICATIONS

Chinese Office Action, Chinese Patent Office, Application No. 202010143128.9, dated Apr. 26, 2021.

*Primary Examiner* — Henok D Legesse

(74) *Attorney, Agent, or Firm* — Greenblum & Bernstein, P.L.C.

(57) ABSTRACT

An image forming apparatus includes a conveyer belt that transports sheets, a platen plate that supports the conveyer belt to be slidable, a head holding unit that holds inkjet heads ejecting ink to sheets transported on the conveyer belt and being arrayed in a direction orthogonal to a transport direction of the conveyer belt, and a pair of gap adjustment units that have ends on one side being respectively attached to both ends of a lower surface of the head holding unit and ends on the other side being attached to an upper surface of the platen plate to adjust a gap between the lower surface of the head holding unit and the upper surface of the platen plate.

5 Claims, 4 Drawing Sheets

(56) References Cited

U.S. PATENT DOCUMENTS

| | | | | |
|---|---|---|---|---|
| 2007/0291056 | A1* | 12/2007 | Tanahashi | B41J 25/308 347/8 |
| 2008/0136850 | A1* | 6/2008 | Shindo | B41J 2/16538 347/8 |
| 2013/0249979 | A1* | 9/2013 | Wing | B41J 25/3088 347/8 |

FOREIGN PATENT DOCUMENTS

| | | | | |
|---|---|---|---|---|
| JP | 2009-285952 | | 12/2009 | |
| JP | 2009285952 | A * | 12/2009 | B41J 2/01 |

* cited by examiner

IMAGE FORMING APPARATUS INCLUDING A PLURALITY OF GAP ADJUSTERS

BACKGROUND

1. Technical Field

The present invention relates to an image forming apparatus that reduces ink stain while appropriately transporting sheets to be transported.

2. Related Art

An example of inkjet image forming apparatuses is an image recording apparatus including a head unit in which line heads are placed in a direction orthogonal to the transport direction of sheets transported by a conveyer belt.

When sheets are transported at a predetermined transport speed while being sucked to the conveyer belt, air currents are generated along the transport direction of the sheets. At this time, minute droplets (mists) generated due to ink ejection and not used for image formation are swept by the air currents. The swept mists sometimes land, for example, at a position displaced from an ejection position within a transport route, so that ink stain is accumulated in the apparatus and the accumulated ink is transferred to sheets, which leads to degradation of the image quality.

Because the mists are less likely to be swept as the gap between a platen and the head unit is smaller, the ink stain in the apparatus can be reduced.

Meanwhile, the probability that the sheets to be transported collide with the head unit is higher as the gap between the platen and the head unit is smaller.

Therefore, the gap amount between the platen and the head unit needs to be appropriately set.

Patent Literature 1 (Japanese Patent Application Laid-open Publication No. 2009-285952) discloses a technique related to an image recording apparatus that adjusts the gap amount between a platen and a head unit.

The head unit includes a gap adjustment mechanism that adjusts the gap amount between the platen and the head unit. The gap adjustment mechanism is located near four vertexes of the lower surface of a head holding unit that holds a CMYK head group. The platen is capable of moving to a recording position where images can be recorded and a standby position more distant from the recording position with respect to the head unit. When the gap amount between the platen and the head unit is to be adjusted, the gap amount is changed by reciprocation of the platen in a direction in which the gap adjustment mechanism is erected.

The platen is manufactured using a plate-like member. The flatness of the plate may include an error and the gap between the platen and the head unit may differ according to the positions of the platen. Considerable manufacturing cost is required to improve the accuracy in the flatness of the plate.

As described above, in the image recording apparatus described in Patent Literature 1, the gap adjustment mechanism is located near the four vertexes of the lower surface of the head holding unit that holds the whole CMYK head group. Accordingly, the gap between heads fixed at the same height and the platen differ according to the heads if an error occurs in the flatness of the platen. This increases the possibility that the ink stain is generated in the apparatus or a transported recording medium collides with the head unit.

The present invention has been made in view of the above problem. An object of the present invention is to provide an image forming apparatus that reduces ink stain while appropriately transporting sheets to be transported.

SUMMARY

In order to achieve the above object, an image forming apparatus according to the present invention comprises:

a conveyer belt that transports sheets;

a conveyer-belt support unit that supports the conveyer belt to be slidable;

a plurality of head holding units that hold inkjet heads ejecting ink to sheets transported on the conveyer belt and being arrayed in a direction orthogonal to a transport direction of the conveyer belt; and a gap adjustment unit that has ends on one side being respectively attached to the head holding units and ends on the other side being attached to the conveyer-belt support unit to adjust a gap between the head holding units and the conveyer-belt support unit.

According to the image forming apparatus of the present invention, it is possible to prevent stain on a tip of a sheet.

BRIEF DESCRIPTION OF DRAWINGS

The invention will now be described with reference to the accompanying drawings wherein.

DETAILED DESCRIPTION

Figure 1:
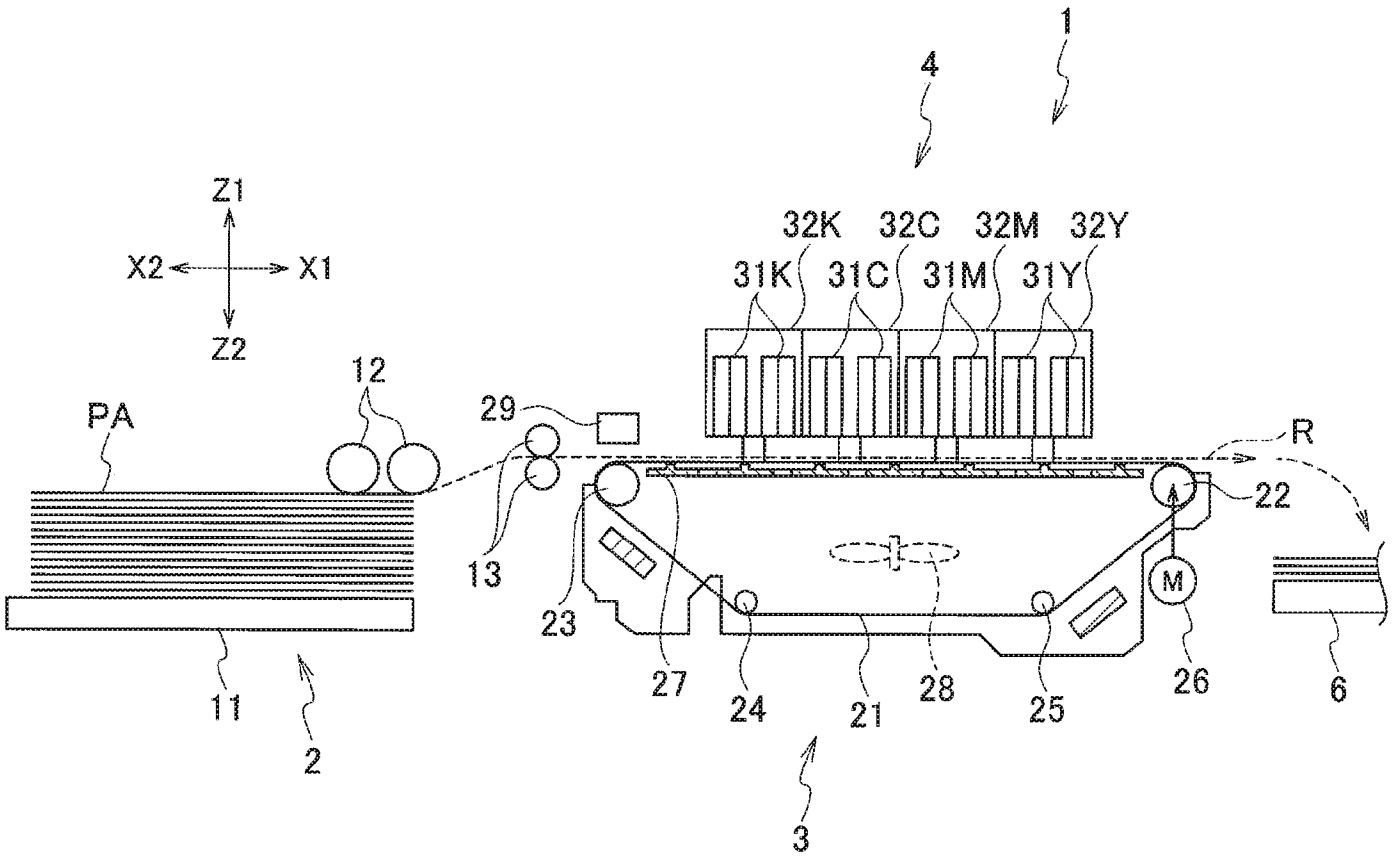
FIG. 1 is a schematic configuration diagram of an inkjet printer according to an embodiment of the present invention.

Embodiments of the present invention will be described below with reference to the drawings. In the drawings, like or equivalent parts or constituent elements are denoted by like or equivalent reference signs. Note that the drawings are schematic and are different from those of actual products. In addition, among the drawings, elements in which the relations and ratios between mutual dimensions thereof are different are also included.

The following embodiments are only examples illustrating a device or the like for realizing the technical ideas of the present invention, and in the technical ideas of the invention, arrangements and the like of respective component parts are not limited to those in the embodiments described below. The technical ideas of the present invention can be variously modified within the scope of claims.

An embodiment of an inkjet printer to which an image forming apparatus according to the present invention is applied will be described below in detail with reference to the accompanying drawings.

Figure 2:
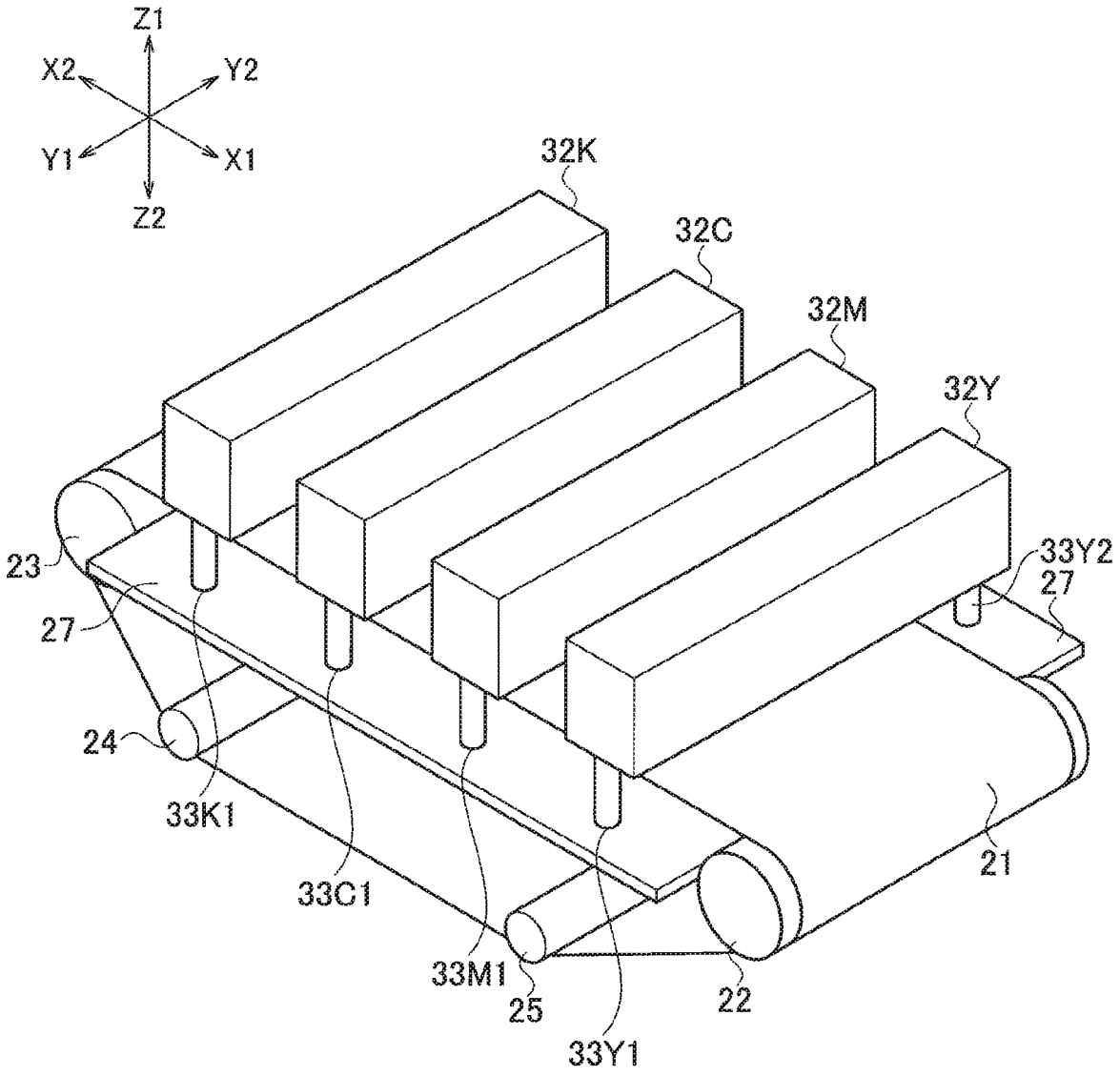
FIG. 2 is perspective view of a head holding unit, a conveyer belt, and a platen plate of the inkjet printer according to the embodiment of the present invention.
Figure 3:
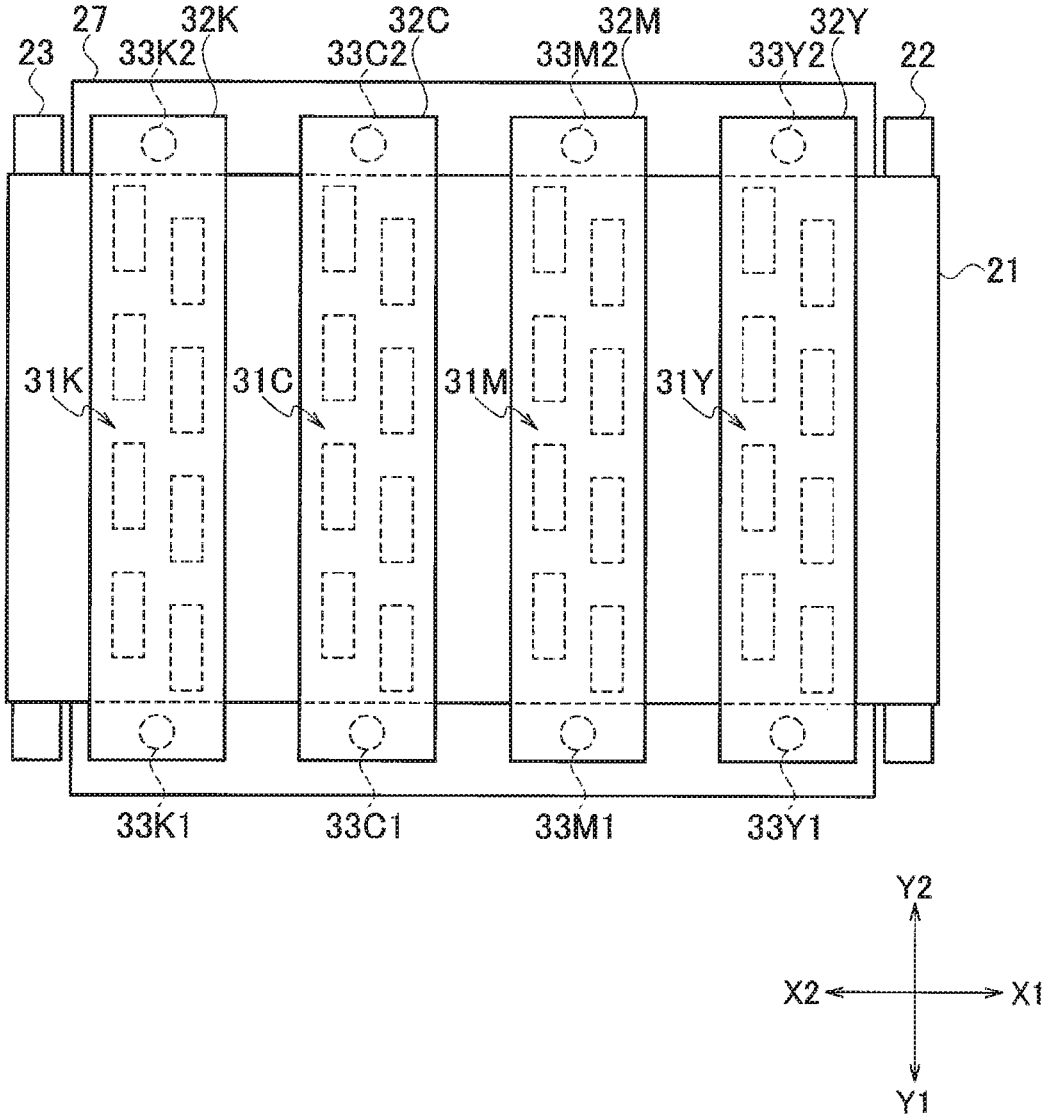
FIG. 3 is a plan view of the head holding unit, the conveyer belt, and the platen plate of the inkjet printer according to the embodiment of the present invention.
Figure 4:
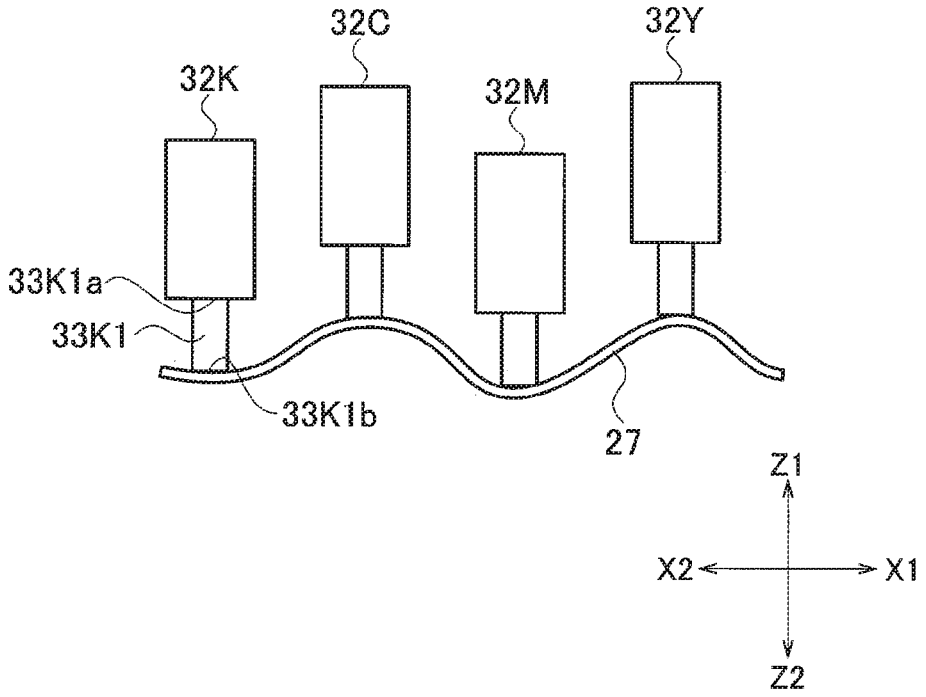
FIG. 4 is a side view schematically illustrating a state of the head holding unit, the conveyer belt, and the platen plate of the inkjet printer according to the embodiment of the present invention at the time of sheet transport.

FIG. 1 is a schematic configuration diagram of an inkjet printer according to the embodiment of the present invention, FIG. 2 is perspective view of a head holding unit, a conveyer belt, and a platen plate of the inkjet printer illustrated in FIG. 1, and FIG. 3 is a plan view of the head holding unit, the conveyer belt, and the platen plate of the inkjet printer illustrated in FIG. 1. FIG. 4 is a side view schematically illustrating a state of the head holding unit, the conveyer belt, and the platen plate of the inkjet printer illustrated in FIG. 1 at the time of sheet transport.

In the following explanations, as illustrated in FIG. 1, the right-left direction is an X1-X2 direction and the upper-lower direction is a Z1-Z2 direction as viewed from a user. The sheet front direction in FIG. 1 where the user is located is a Y1 direction and the sheet back direction is a Y2 direction. A route indicated by a broken line in FIG. 1 is a transport route R on which sheets PA being print media are transported. Upstream and downstream in the following explanations mean upstream and downstream of the transport route R.

As illustrated in FIGS. 1 to 3, the inkjet printer 1 includes a feeder unit 2, a suction transport unit 3, a printing unit 4, and a delivery unit 6.

The feeder unit 2 feeds the sheets PA being print media. The feeder unit 2 includes a feed tray 11, a feed roller 12, and a registration roller 13.

The sheets PA used for printing are stacked on the feed tray 11.

The feed roller 12 picks up the sheets PA stacked on the feed tray 11 one by one and transports the sheet PA to the registration roller 13. The feed roller 12 is located above the feed tray 11. The feed roller 12 is rotationally driven by a motor (not illustrated).

The registration roller 13 temporarily stops the sheet PA transported by the feed roller 12 and then transports the sheet PA toward the suction transport unit 3. The registration roller 13 is located downstream of the feed roller 12. The registration roller 13 is rotationally driven by a motor (not illustrated).

The suction transport unit 3 transports the sheet PA transported from the registration roller 13 toward the printing unit 4 and the delivery unit 6. The suction transport unit 3 includes a conveyer belt 21, a driving roller 22, driven rollers 23 to 25, a belt driving motor 26, a platen plate 27, a suction fan 28, and a sheet floating sensor 29.

The conveyer belt 21 is an annular endless belt that is laid across the driving roller 22 and the driven rollers 23 to 25. Many air intake holes (not illustrated) being through holes for adsorptively holding the sheet PA are formed on the conveyer belt 21. The conveyer belt 21 adsorptively holds the sheet PA on the upper surface of the conveyer belt 21 with a negative pressure (adsorption power) generated on the air intake holes due to driving of the suction fan 28.

The conveyer belt 21 rotates in a clockwise direction in FIG. 1 due to rotational driving of the driving roller 22. This causes the conveyer belt 21 to endlessly move, thereby transporting the sheet PA, which is adsorptively held on the upper surface of the conveyer belt 21, in the X1 direction.

The driving roller 22 and the driven rollers 23 to 25 are members across which the conveyer belt 21 is laid. The driving roller 22 is rotationally driven by the belt driving motor 26 and rotates the conveyer belt 21. The driven rollers 23 to 25 are driven by the driving roller 22 via the conveyer belt 21. The driven roller 23 is placed a predetermined distance apart from the driving roller 22 in the X1-X2 direction at a substantially same level as the driving roller 22. The driven rollers 24 and 25 are placed a predetermined distance apart from each other in the X1-X2 direction at a substantially same level below the driving roller 22 and the driven roller 23.

The belt driving motor 26 rotationally drives the driving roller 22.

The platen plate 27 is placed between the driving roller 22 and the driven roller 23 partially below the conveyer belt 21 and supports the lower surface of the conveyer belt 21 to be slidable. The platen plate 27 has a plurality of suction holes (not illustrated) penetrating from the upper surface to the lower surface at positions where the air intake holes of the conveyer belt 21 pass. The platen plate 27 also includes a plurality of reinforcements (not illustrated) in the Y1-Y2 direction.

The suction fan 28 is placed below the platen plate 27 and generates air currents in a downward direction (the Z2 direction). Accordingly, the suction fan 28 sucks air through the suction holes of the platen plate 27 and the air intake holes of the conveyer belt 21 to generate a negative pressure, and causes the sheet PA to be adsorbed on the conveyer belt 21.

The sheet floating sensor 29 is located upstream of inkjet heads 31 and downstream of the registration roller 13, and detects floating of the sheet PA transported by the suction transport unit 3.

The printing unit 4 performs printing on the sheet PA transported by the suction transport unit 3. The printing unit 4 is located above the suction transport unit 3. The printing unit 4 is fixed within a body (not illustrated) of the inkjet printer 1. The printing unit 4 includes inkjet heads 31K, 31C, 31M, and 31Y of black (K), cyan (C), magenta (M), and yellow (Y) (hereinafter, also "inkjet heads 31"), a plurality of head holding units 32K, 32C, 32M, 32Y (hereinafter, also "head holding units 32") that respectively hold the corresponding inkjet heads 31, and a plurality of head-gap adjustment units 33K, 33C, 33M, and 33Y (hereinafter, also "head-gap adjustment units 33").

The inkjet heads 31 of each ink color are arrayed in two lines in the Y1-Y2 direction in a staggered manner with no space therebetween with respect to the sheet PA transported in the X1 direction by the suction transport unit 3 as illustrated in FIG. 3.

The head holding unit 32K holds the inkjet heads 31K above the suction transport unit 3. The head holding unit 32K is formed in a hollow and substantially cuboid shape. The head holding units 32C, 32M, and 32Y also have an identical configuration to that of the head holding unit 32K.

The head-gap adjustment unit 33K is a member that adjusts a gap being the distance between the lower surface of the head holding unit 32K and the upper surface of the platen plate 27. As illustrated in FIG. 3, the head-gap adjustment unit 33K includes a head-gap adjustment unit 33K1 placed on the lower surface of the head holding unit 32K on the Y1 side and a head-gap adjustment unit 33K2 placed on the lower surface of the head holding unit 32K on the Y2 side. That is, a pair of the head-gap adjustment unit 33K1 and the head-gap adjustment unit 33K2 constitutes the head-gap adjustment unit 33K.

The head-gap adjustment unit 33K1 has one end 33K1*a* attached to the lower surface of the head holding unit 32K and the other end 33K1*b* attached to the upper surface of the platen plate 27 as illustrated in FIG. 4. The head-gap adjustment unit 33K2 is also attached in the identical manner to the head-gap adjustment unit 33K1.

The head-gap adjustment unit 33K (33K1 and 33K2) has a mechanism that is capable of adjusting the length in the upper-lower direction (the Z1-Z2 direction) and can adjust the length according to the resolution of the inkjet heads 31K, the ink characteristics of ink ejected from the inkjet heads 31K, or the like.

The head-gap adjustment units 33C, 33M, and 33Y also have an identical configuration to that of the head-gap adjustment unit 33K. That is, because the head-gap adjustment units 33K, 33C, 33M, and 33Y are respectively provided for the corresponding head holding units 32K, 32C, 32M, and 32Y, a gap being the distance between the lower surface of one of the head holding units 32 and the upper surface of the platen plate 27 can be adjusted with respect to each of the head holding units 32K, 32C, 32M, and 32Y.

As described above, in the inkjet printer 1 according to the embodiment of the present invention, the ends on one side of each of the head-gap adjustment units 33 are respectively attached to both ends of the lower surface of the corresponding head holding unit 32 and the ends on the other side of the head-gap adjustment unit 33 are attached to the upper surface of the platen plate 27 so as to adjust the gap between the lower surface of the head holding unit 32 and the upper surface of the platen plate 27.

Accordingly, with respect to each of the head holding units 32K, 32C, 32M, and 32Y, a gap being the distance between the lower surface of the head holding unit 32 and the upper surface of the platen plate 27 can be adjusted by the corresponding head-gap adjustment unit 33. Therefore, even when an error occurs in the flatness of the platen plate 27 and the platen plate 27 is deformed to undulate in the upper-lower direction (the Z1-Z2 direction) as illustrated in FIG. 4, the locations of the head holding units 32 in the upper-lower direction (the Z1-Z2 direction) are enabled to follow the deformation of the platen plate 27 to always keep a constant gap.

Accordingly, the ink stain in the apparatus due to mists can be reduced and degradation of the image quality can be reduced while the sheets PA to be transported can be appropriately transported without colliding with the inkjet heads 31.

As described above, the head-gap adjustment units 33 have a mechanism capable of adjusting the length in the upper-lower direction (the Z1-Z2 direction) and can adjust the length according to the resolution of the inkjet heads 31.

As the resolution of the inkjet heads 31 is higher, the number of nozzles that eject ink is larger and thus the amount of mists generated during transport of the sheets PA is likely to increase. Therefore, the head-gap adjustment units 33 can adjust the lengths to cause the gap to be smaller as the resolution of the inkjet heads 31 is higher.

Accordingly, an appropriate gap can be set for each of the head holding units 32 according to the resolution of the inkjet heads 31. Therefore, the ink stain in the apparatus due to the mists can be reduced more to reduce degradation of the image quality while the sheets PA to be transported are appropriately transported without colliding with the inkjet heads 31.

Furthermore, each of the head-gap adjustment units 33 can adjust the length according to the ink characteristics of ink ejected from the corresponding inkjet head 31. The ink characteristics include viscosity, noticeability of the color, and the like.

When the viscosity of ink is high, an applied voltage at the time of ejection from the inkjet head 31 needs to be increased. When the applied voltage is increased, the amount of mists generated at the time of ejection of the ink is increased correspondingly. Therefore, for example, the head-gap adjustment units 33 can adjust the lengths to cause the gap to be smaller as the viscosity of ink ejected from the inkjet heads 31 is higher.

Furthermore, the noticeability of ink differs according to the colors. For example, while yellow (Y) is less noticeable, black (K) is easily noticeable. Therefore, for example, the head-gap adjustment units 33 can adjust the lengths to cause the gap to be smaller to reduce the mist amount as the color of ink ejected from the inkjet heads 31 is more easily noticeable.

Accordingly, an appropriate gap can be set for each of the head holding units 32 according to the ink characteristics. Therefore, the ink stain in the apparatus due to the mists can be further reduced to reduce degradation of the image quality while the sheets PA to be transported are appropriately transported without colliding with the inkjet heads 31.

Although the inkjet printer 1 having the inkjet heads 31C, 31K, 31M, and 31Y of each ink color that are arrayed in two lines in the Y1-Y2 direction in a staggered manner, and the head holding units 32C, 32K, 32M, and 32Y that respectively hold the inkjet heads of the corresponding colors has been explained as an example in the embodiment of the present invention, the present invention is not limited thereto.

For example, the inkjet printer may include head holding units that respectively hold lines of inkjet heads where the inkjet heads of each ink color are arrayed in two lines in the Y1-Y2 direction in a staggered manner. Also in this case, a head-gap adjustment unit is provided for each of the head holding units.

<Others>

The present invention is not limited exactly to the above embodiment, and when the invention is actually implemented, it may be embodied in other specific forms while modifying the constituent elements without departing from the spirit of the invention. In addition, various inventions may be formed by appropriate combinations of a plurality of constituent elements disclosed in the above embodiment. For example, several constituent elements may be omitted from all the constituent elements described in the above embodiment.

This application claims priority based on Japanese Patent Application No. 2019-058708 filed on Mar. 26, 2019, and the entire content of this application is incorporated herein by reference.

REFERENCE SIGNS LIST

1 inkjet printer
2 feeder unit
3 suction transport unit
4 printing unit
6 delivery unit
11 feed tray
12 feed roller
13 registration roller
21 conveyer belt
22 driving roller
23 to 25 driven roller
26 belt driving motor
27 platen plate (conveyer-belt support unit)
28 suction fan
29 sheet floating sensor
31 (31K, 31C, 31M, 31Y) inkjet head
32 (32K, 32C, 32M, 32Y) head holding unit
33 (33K, 33C, 33M, 33Y) head-gap adjustment unit
33K1*a*, 33K1*b* one end

What is claimed is:

1. An image forming apparatus comprising:

a conveyer belt that transports sheets;

a conveyer-belt support that supports the conveyer belt to be slidable;

a plurality of head holders that hold inkjet heads ejecting ink to sheets transported on the conveyer belt and being arrayed in a direction orthogonal to a transport direction of the conveyer belt; and a plurality of gap adjusters that each include an end on one side being respectively attached to a respective head holder of the head holders and an end on another side being attached to the conveyer-belt support, to each independently adjust a gap between the respective head holder and the conveyer-belt support.

2. The image forming apparatus according to claim 1, wherein the gap is defined in the gap adjusters according to resolutions of the inkjet heads.

3. The image forming apparatus according to claim 2, wherein the gap is defined in the gap adjusters on a basis of ink characteristics of the ink ejected from the inkjet heads.

4. The image forming apparatus according to claim 1, wherein the gap is defined in the gap adjusters on a basis of ink characteristics of the ink ejected from the inkjet heads.

5. The image forming apparatus according to claim 1, wherein the head holders are each adjustable to a first height position that is different than a second height position of at least one other head holder of the head holders.

* * * * *